United States Patent [19]

Johnson

[11] 4,065,063

[45] Dec. 27, 1977

[54] IMPACT CRUSHER

[75] Inventor: Louis W. Johnson, Eugene, Oreg.

[73] Assignee: El-Jay, Inc., Eugene, Oreg.

[21] Appl. No.: 702,394

[22] Filed: July 6, 1976

[51] Int. Cl.[2] ..... B02C 13/09

[52] U.S. Cl. ..... 241/275

[58] Field of Search ..... 241/275, 300, DIG. 10

[56] References Cited

U.S. PATENT DOCUMENTS

| | | | |
|---|---|---|---|
| 3,174,697 | 3/1965 | Bridgewater | 241/275 |
| 3,174,698 | 3/1965 | Miller | 241/275 |
| 3,474,974 | 10/1969 | Wood | 241/275 |
| 3,606,182 | 9/1971 | Warren | 241/275 |
| 3,767,127 | 10/1973 | Wood | 241/DIG. 10 X |
| 3,873,047 | 3/1975 | Johnson | 241/275 |
| 3,955,767 | 5/1976 | Hise | 241/275 |

*Primary Examiner*—Roy Lake

*Assistant Examiner*—Howard N. Goldberg

*Attorney, Agent, or Firm*—Klarquist, Sparkman, Campbell, Leigh, Hall & Whinston

[57] ABSTRACT

A flared distributor cap of a rotated impeller assembly directs material to be crushed radially outwardly to scoop-like impeller shoes which fling the material outwardly against breaker bars. The impeller shoes hook over mounting blocks and a pin and a screw will retain a shoe in place should the hook break. An annular distributor table carrying the mounting blocks and shoes has an annular, undercut groove in which interchangeable arcuate segmental wear plates fit. An undercut peripheral edge of a distributor cap overlies beveled, inner peripheral edges of the wear plates to lock them in position. Upper wear plates are secured to an annular distributor table cover, and have undercut grooves into which the cover fits.

16 Claims, 8 Drawing Figures

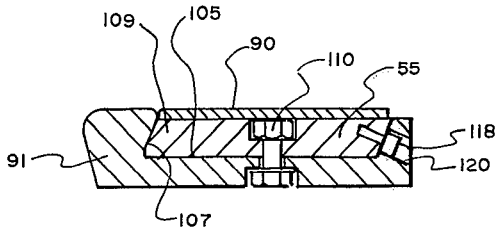
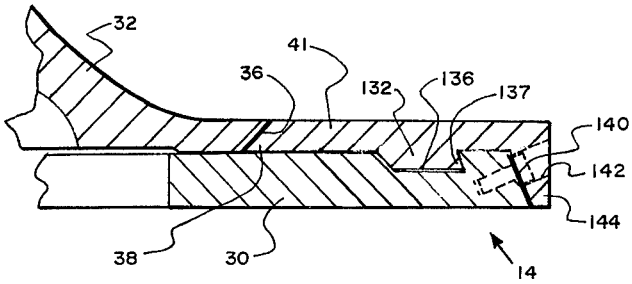
FIG. 6
FIG. 5
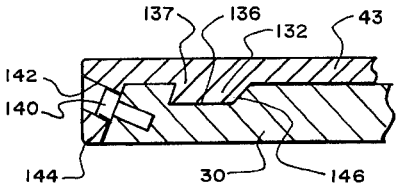
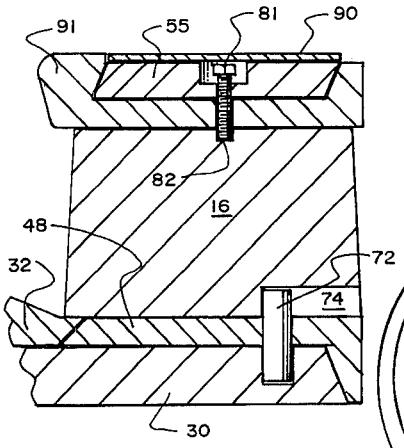
FIG. 8
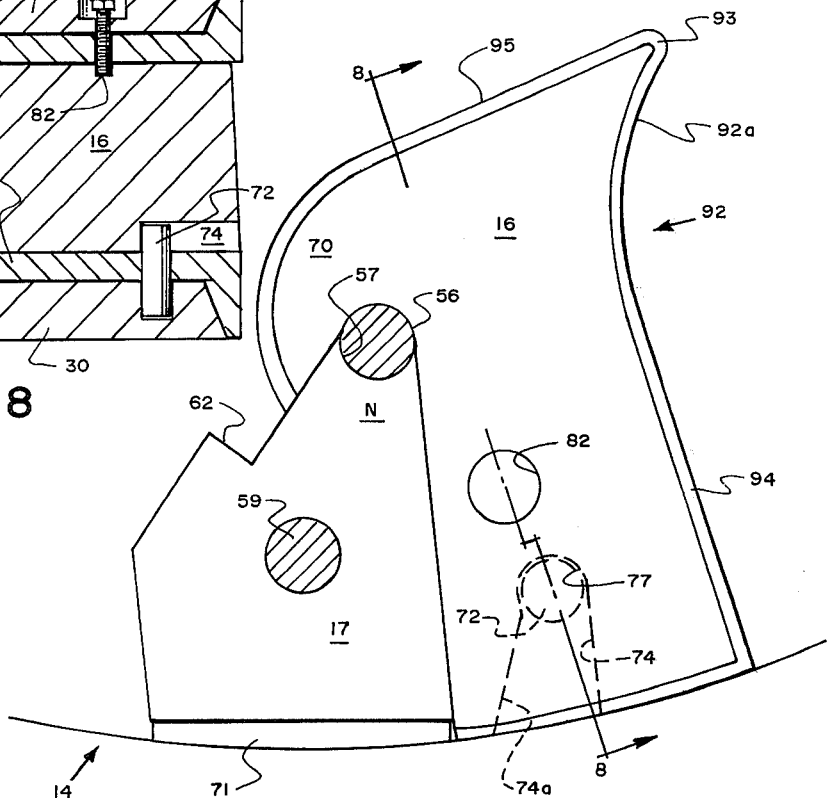
FIG. 7

IMPACT CRUSHER

DESCRIPTION

This invention relates to an improved crusher, and has for an object thereof the provision of an improved impact crusher.

Another object of the invention is to provide an impact crusher having scoop-like impeller shoes.

A further object of the invention is to provide an impact crusher having improved structure for mounting impeller shoes thereof.

Another object of the invention is to provide an impact crusher having a distributor table cap overhanging wear plates to hold the wear plates in interlocking engagement with an annular distributor table.

Another object of the invention is to provide an impact crusher with segmental wear plates that can be interchanged to distribute wear more uniformly.

Another object of the invention is to provide an impact crusher having wear plates and a distributor table having interlocking portions preventing radially outward movement of the wear plates.

Another object of the invention is to provide an impact crusher including upper wear plates interlocking with and carried by a distributor table cover.

Another object of the invention is to provide in an impact crusher safety features to retain parts in place, should primary securing means fail.

In the drawings:

FIG. 5 is an enlarged vertical sectional view taken along line 5—5 of FIG. 3;

FIG. 6 is an enlarged vertical sectional view taken along line 6—6 of FIG. 3;

FIG. 7 is an enlarged, fragmentary, horizontal sectional view of a portion of the crusher of FIG. 1; and FIG. 8 is a vertical sectional view taken along line 8—8 of FIG. 7, on the same scale as FIG. 5.

Figure 1:
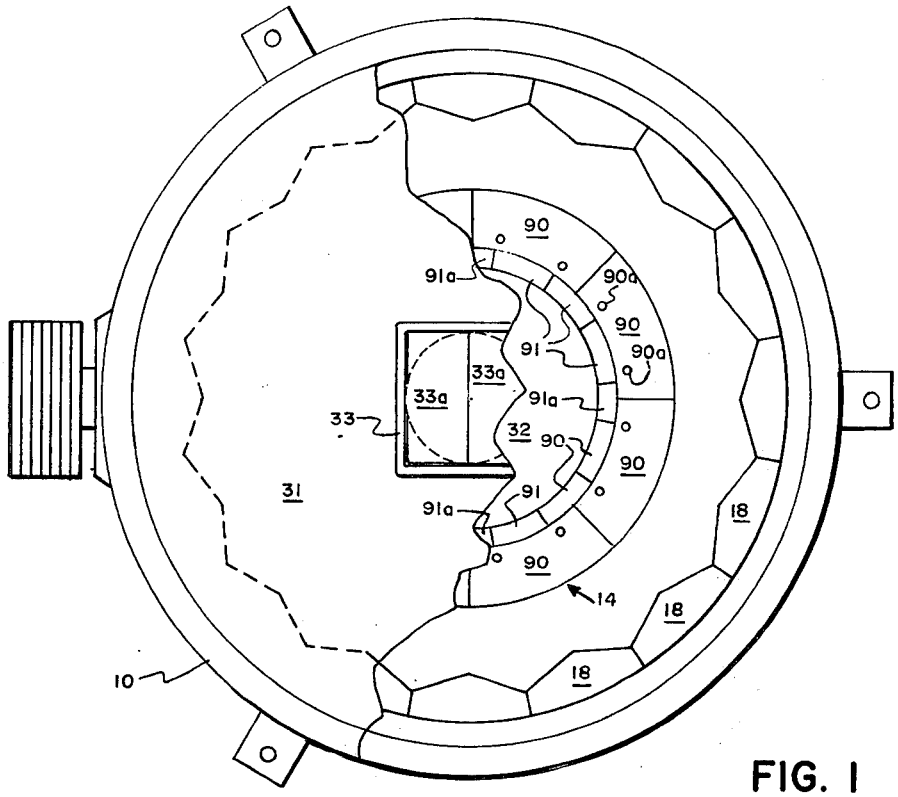
FIG. 1 is a top plan view of an improved impact crusher forming one embodiment of the invention with portons thereof broken away.
Figure 2:
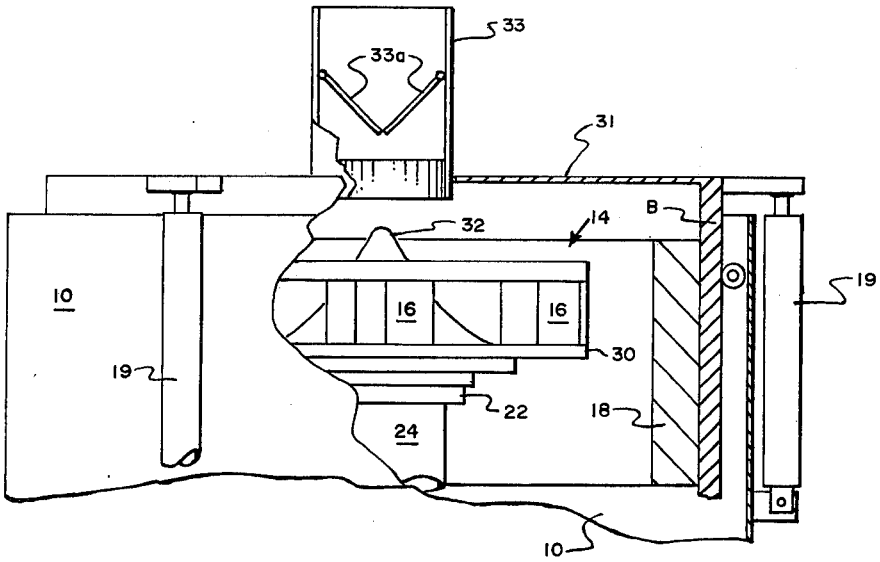
FIG. 2 is a partially sectional, elevation view of the crusher of FIG. 1.

Referring now in detail to the drawings, there is shown therein an improved impact crusher forming a specific embodiment of the invention and including a housing or frame 10 (FIGS. 1 and 2) within which is located an impeller or distributor table assembly 14 having four impeller shoes 16 (FIG. 2) of hard wear-resistant metal. While four shoes 16 are shown, more or less could be used. The shoes are disposed around the impeller at equal distances from one another.

The shoes are mounted on mounting blocks 17 (FIG. 3) and strike and throw material to be crushed against breaker bars 18 (FIG. 1) of a breaker bar assembly B. The latter is mounted within the housing 10 for slow vertical reciprocating movement under the control of power units 19 on the housing, to distribute the wear on bars 18. The above general relationship is the same as that disclosed and claimed in my U.S. Pat. No. 3,873,047.

The impeller assembly is mounted on and secured by bolts 21 (FIGS. 3 and 4) to a hub 22 (FIGS. 2 and 4) rotated and supported by drive structure 24 like that disclosed in my abovementioned patent. The impeller assembly 14 includes an annular distributor table 30 (FIGS. 3 and 4) of high strength steel, and also includes a distributor table cap 32 of hard wear-resistant metal which is maintained in place in a manner to be presently described.

A cover 31 (FIG. 2), of the breaker bar assembly B, has an opening through which the lower end of a feed spout 33 projects, in centered relation to the cap 32. The lower end of the spout is circular in cross section, but the spout changes abruptly to a square cross section to accommodate a pair of spring biased pivoted valve plates 33*a.* which restricts the entry of air into the interior of the crusher, thereby minimizing the blowing of dust from the discharged products of the crusher. The spout is supported in a fixed position, relative to the movable breaker bar assembly B, by a bridging super structure (not shown) which is mounted on the crusher frame 10.

The upper surface of cap 32 is flared or concavely conoidal in longitudinal cross section so that it smoothly changes the direction of flow of the material to be crushed from vertical to radially outwardly. This smooth change of direction helps the material retain its momentum and also helps prevent bouncing of the material. Cap 32 has a lifting hole 34 (FIGS. 3 and 4) therein through which a pin (not shown) may be placed when it is desired to lift or lower the cap relative to distributor table 30.

The cap has an undercut beveled outer edge 36 IFIG. 5) which overlies complementarily beveled inner peripheral edges 38 of four sets of identical lower wear plates 41, 42 and 43 (FIGS. 3 and 5) forming segments of an annulus. While three plates are shown for each set, more or less could be provided. The plates are formed of hard wear-resistant metal and are detachably secured to the distributor table 30 in a manner to be presently described.

The inner edges 38 of the wear plates form a circular edge which centers the cap 32 and thus prevent it from shifting or sliding radially outwardly. The weight of the cap, bearing down on the wear plate edges 38, holds down the wear plates at their inner ends. The impeller shoes 16 project inwardly to overlie the outer edge of the cap to preclude upward movement of the cap. The cap is free to turn relative to the shoes and wear plates, being restrained only by friction. Preferably the edge of cap 32 is in the form of a replaceable ring (not shown) which has an interfitting relation with the body of the cap. When the edge wears away to an undesired extent, it can be replaced.

Figure 3:
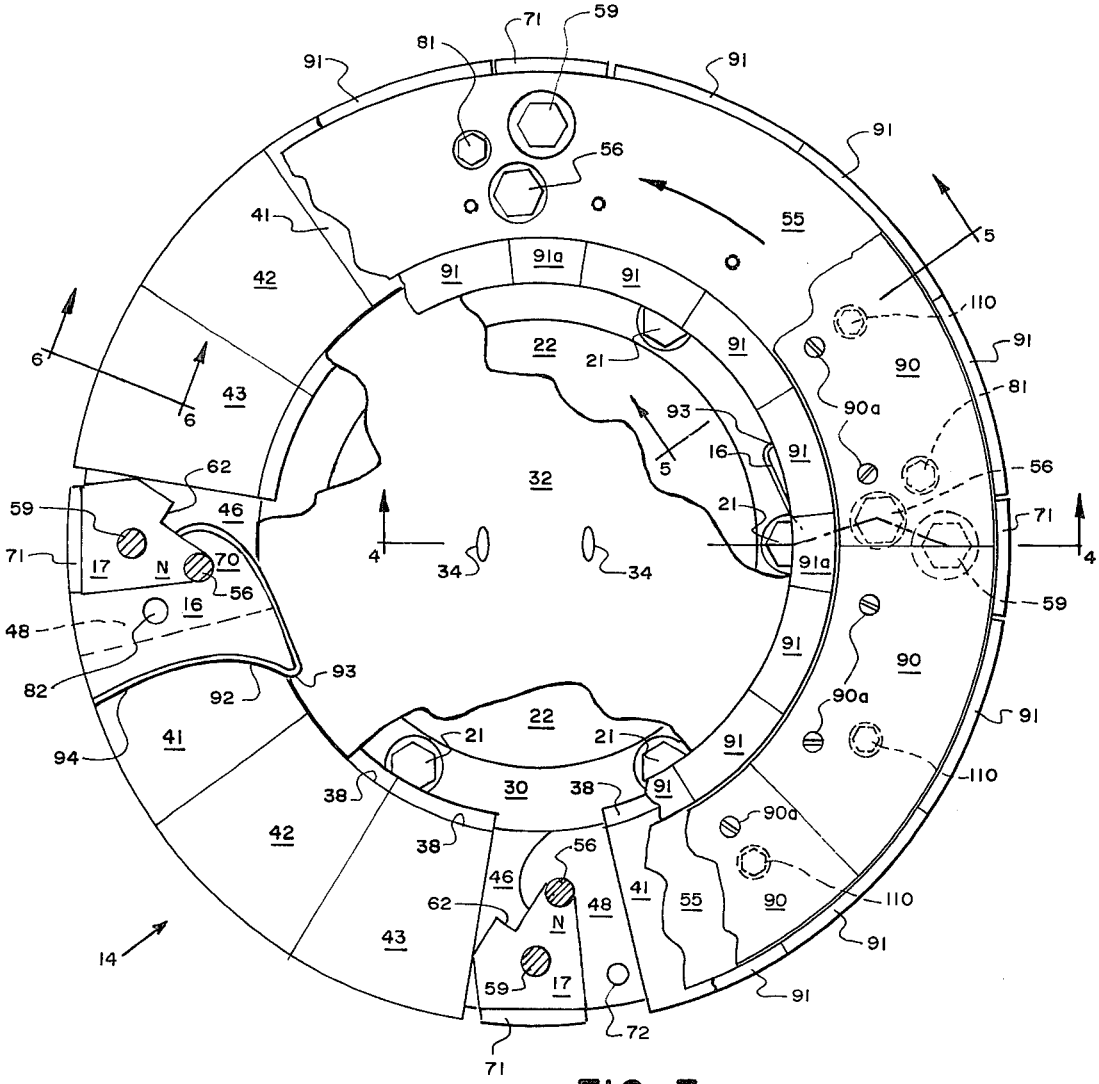
FIG. 3 is an enlarged top plan view of the impeller assembly with portions thereof broken away.

The wear plates of each set are in contiguous relation to one another but the end plates are spaced from the end plates of the adjacent sets to provide spaces for mounting the impeller shoes 16 (FIG. 3). At each space is a mounting block 17 for the associated shoe 16. The block is of irregular polygonal shape in plan. A filler plate 46 and a shoe plate 48, the latter being of the same hook profile as the overlying portion of the associated shoe, abut against one another and the block 17, and cover most of the exposed space not occupied by the block.

Plate 46 is hard faced or comprises a wear-resistant metal casting, because it is exposed to the passage of the material being crushed, while plate 48 need not be wear-resistant, being covered by its shoe 16. However, plate 48 must be of high strength steel, for a reason to be presently apparent. The inner edges of the plates 46 and 48 are overlain by the cap edge 36 (FIG. 4 for plate 48) which retains the plate 46 in place. A wear strip 48*a* (FIG. 4) is secured to the outer edge of plate 48 in any convenient manner.

While the shoe plate is of the same profile as that of the overlying shoe portion, it is sufficiently smaller so that the anticipated wear on the shoe will not expose the shoe plate to the abrasive action of the material being crushed. The edge of the shoe plate next to the associated wear plate 41 is straight and abuts against the adjacent straight edge of such wear plate. These meeting edges are covered by the body of the associated shoe so that the straight edge of the shoe plate is protected from abrasion.

Each shoe mounting block 17 has a boss 50 (FIG. 4) fitting in a hole formed in the table 30, and each block is permanently welded to the table. The blocks support an overlying mild steel annular distributor table cover 55, in a manner to be presently explained.

Figure 4:
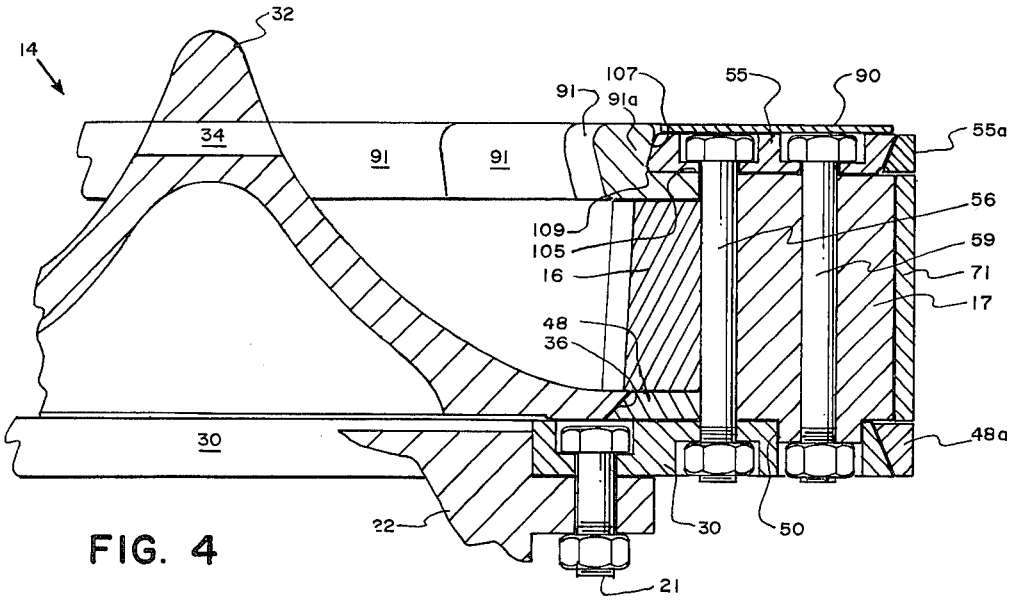
FIG. 4 is an enlarged vertical sectional view taken along line 4—4 of FIG. 3.

Each block has an inwardly directed nose N (FIGS. 3 and 7) the inner end of which is provided by a bolt 56, which fits in a semi-cylindrical groove 57 in the block. Bolt 56 extends through the table 30 and the distributor cover 55 and is countersunk at its ends into these elements (FIG. 4).

The cover 55 is supported by being clamped down against the blocks 17 by bolts 59 (FIG. 4), there being one for each block. Each block is bored to receive its bolt, and each bolt has its ends countersunk into the cover 55 and table 30. The bolts 56, mentioned above, serve as additional means for attaching the cover in place.

Each mounting block 17 projects outwardly at 62 (FIG. 3) for strength purposes. Hard peripheral wear plates 71 (FIGS. 3 and 7) are secured at their side edges to the outer face of the mounting block 17 by welds. While the welds are sufficient to hold the wear plates 71 in place, the plates 71 can be easily cut off to facilitate welding a replacement wear plate in place. Instead of wear plates, the outer surfaces of the blocks 17 could be hard faced.

Each impeller shoe 16 (FIGS. 3 and 7) has a hook 70 which hooks over the nose N of the associated block 17. In case the hook breaks, a safety feature is provided to prevent the main body portion of the shoe from flying outward and causing damage. This safety feature includes a strong stop pin 72 (FIG. 8) carried by and having a press fit with shoe plate 48 and having an upper portion projecting into a bottom slot 74 (FIGS. 7 and 8) for the shoe. The slot has a semicircular socket portion 77 (FIG. 7) fitting against and partially around the stop pin 72. The pin 72 has a lower portion which fits into a blind bore in the distributor table 30. Should the hook 70 of the shoe break off, the fit of the body of the shoe against the block 17 will prevent it pivoting about safety pin 72. Thus, the pin, alone will hold the body of the shoe in place.

However, an additional safety feature is provided and comprises a stop in the form of a socket head cap screw 81 (FIG. 8). The screw fits into a detent socket 82 formed in the upper face of the shoe 16 and is disposed below a wear liner 90 for the cover 55. The screw 81 threads into and passes through the cover 55 and through an upper wear plate 91 before projecting into the socket 82. The stop pin 72 and the screw 81 assure that the body of the shoe will remain in place in the event the hook 70 breaks off.

The bottom slot 74 is relieved at 74*a* (FIG. 7) to enable the shoe to be manipulated when mounting or demounting it, as demanded by the fit of the hook 70 and the nose N.

The wear liner 90 is of wear-resistant metal and is of segmental form, each segment being secured in place by a pair of screws 90*a* countersunk into the liner.

Each shoe 16 tapers slightly from its top face to its lower face (compare FIGS. 4, 7 and 8). This makes the shoe larger at its base than at its top, which is desirable because the shoe wears more at its lower portion than at its upper.

An important feature of the shoe 16 is that each has a scoop-like leading face 92 (FIGS. 3 and 7) defined in part by a nose or tip 93 pointing forwardly. Thus, the leading face has a concave portion 92*a* (FIG. 7) at the nose 93 which blends into a straight portion 94, which extends substantially radially. The inner face 95 of the shoe slopes vertically and generally radially outwardly from the nose 93 to permit material, not caught by the scoop, to move easily therepast.

Wear plate 91 is one of four sets of segmental wear plates all of which are of wear-resistant metal and are labeled 91 and which extend around and in spaced relation to the cap 32 (FIG. 5) to define an annular opening for the downward passage of material to be crushed. Each wear plate is formed with a top-side groove 105 of the same cross sectional shape as that of the table cover 55 to accommodate the cover. The groove 105 and the cover 55 are of rhomboidal cross sectional form (FIG. 5), with the inner portion of the groove being undercut at 107 to receive a nose 109 of the cover. Each wear plate is secured to the cover by a bolt 110 (FIG. 5) which is countersunk at both its ends.

A safety feature is provided to retain each wear plate 91 in place even if the associated bolt 110 loosens or breaks. This comprises a socket head cap screw 118 (FIG. 5), the socket head of which is accommodated by a bore 120 in the outer flange portion of the wear plate, and the shank of which screws into the outer edge of the table cover. Should the bolt 110 of the wear plate loosen or break, the fit of the nose 109 of the cover in the undercut 107 and the fit of the head of the socket 118 in the bore 120 will retain the wear plate in place.

There is a specially formed upper wear plate 91*a* (FIG. 4) for each of the mounting blocks 17. Each wear plate 91*a* is formed to fit against the inner face of its block and is held in place by welding or by a bolt or screw (not shown) or in any other convenient manner. The outer edge of the cover plate is left exposed at each wear plate 91*a*. This edge portion is covered at each mounting block by a wear strip 55*a* which is secured in place in any convenient fashion.

The lower wear plates 41, 42 and 43 (FIG. 5) are releasably locked to the distributor table 30 as follows: each lower wear plate has a depending arcuate rib 132 fitting in a circular groove 136 formed in the table 30. The groove is outwardly undercut, and the rib has an outwardly projecting edge 137 to fit in the undercut. This fit, plus the overlap of the cap 32 and the inner edge 38 of the lower wear plate, will retain the lower wear plate in place. Also, each wear plate 41 is retained in place by the overlapping relationship of the associated shoe.

In addition, there is a socket head cap screw 140 (FIGS. 5 and 6) screwed into the outer edge of the distributor table 30 and having its head fitting in a bore 142 in a depending flange 144 of the wear plate. The angle of the flange with the opposed face of the table and the angles of the rib 132 with the opposed faces of the groove 136 are such as to permit easy insertion of the rib 132 into the groove 136 (whenever the cap 32 and the screw 140 are removed).

OPERATION

Material to be crushed is dropped through the spout 33 (FIGS. 1 and 2) onto the distributor table cap 32 which smoothly deflects the material radially outwardly toward the shoes 16 and the spaces between the shoes. This, plus the centrifugal action of the distributor table, which is rotated at a high speed in a counterclockwise direction, as viewed in FIG. 3, tends to move the material radially outwardly. The shoes not only have a scoop-like action but also an impact action and engage the material and break some of it by forceful contact with it and throw such material outwardly with a tremendous impact against the breaker bars 18. This crushes the material, and the crushed material drops through the housing 10 into a suitable receiver (not shown). The speed of the shoes may be in the order of 10,000 feet per minute.

Plates 41 wear more rapidly than plates 42 and 43, because plates 41 are closer to the shoes 16 than are plates 42 and 43. When the plates become worn, the cover 31 is removed, and the cap 32 and the shoes 16 are then loosened. Then capscrews 140 (FIG. 6) are removed, the plates 41 are removed and the plates 42 and 43 are slid one place clockwise, as viewed in FIG. 3 to occupy the spaces formerly occupied by the plates 41 and 42, respectively. Plates 41 are then placed in the spaces formerly occupied by the plates 43. The cap 32 and the shoes 16 are then again secured in fixed positions and capscrews 140 are reinserted into place. When the plates 42 become sufficiently worn, the above procedure is repeated to place the plates 43 in the positions of most wear with the plates 42 going to the far end of the line.

The upper wear plates 91 are similarly shiftable, being interchangeable to compensate for greater wear near the impeller shoes.

What is claimed is:

1. In an impact crusher:
a rotatable distributor table,
a plurality of impeller shoes mounted in spaced positions around the distributor table,
and a plurality of segmental wear plates forming portions of an annulus and extending around the distributor table between the impeller shoes,
said table having a groove therearound,
each wear plate having a rib projecting into said groove for retaining purposes.

2. The crusher of claim 1 wherein the table groove and the wear plate ribs provide have interengaging complementary undercut wall portions preventing upward and radially outward movement of the wear plates relative to the table.

3. The crusher of claim 2 including a distributor table cap having a base having a bevelled edge engaging the inner edge portions of the wear plates, the inner edge portions of the wear plates being bevelled and fitting under the bevelled edge of the cap.

4. The crusher of claim 1 including a distributor table cap having a peripheral portion overhanging and radially engaging the inner peripheral portions of the wear plates.

5. In an impact crusher,
a distributor table rotated on a predetermined axis and having an annular groove having a wall facing radially inwardly,
a wear plate having an arcuate rib having a wall facing radially outwardly and adapted to interlockingly engage the wall of the groove,
and clamping means engaging the wear plate and pressing the wear plate against the distributor table.

6. The crusher of claim 5 wherein the clamping means comprises a distributor table cap having a bevelled edge portion overlapping the inner edge of the wear plate.

7. In an impact crusher:
a rotatable distributor table,
a plurality of impeller shoes mounted on the distributor table,
a plurality of interchangeable segmental upper wear plates each having a groove therein with an undercut radially inwardly positioned wall,
an annular distributor table cover fitting in the groove and having a sloping inner wall adapted to fit against the undercut wall,
and means locking the wear plates to the distributor table cover.

8. The crusher of claim 7 wherein the wall of each groove facing the undercut wall thereof slopes in the same direction as the undercut wall.

9. The crusher of claim 8 including bolt means holding the wear plates and the cover together.

10. The crusher of claim 9 wherein the wear plates have generally radial bores extending from the outer portions into the grooves, and screws extending into the bores and screwed into tapped bores in the cover.

11. The crusher of claim 10 wherein the cover includes a lower body member of a predetermined hardness and an upper wear plate of a greater hardness covering the body member.

12. In an impact crusher:
a distributor table rotatable on a predetermined axis,
a mounting block mounted on the table spaced outwardly from said axis and having a groove at its most radially inward portion,
an impeller shoe having a hook portion,
and a bolt extending along the groove and the hook portion of the shoe to hold the shoe and the mounting block against the table,
a stop member fixed in an upstanding position on the distributor table, the impeller shoe having a radially outwardly opening slot in the lower portion thereof receiving the stop member.

13. In an impact crusher,
a distributor table rotatable on a predetermined axis,
a mounting block fixed to the table,
an impeller shoe having a hook portion hooking on the mounting block and having a bottom opening,
and a stop member on the table projecting into the bottom opening.

14. The crusher of claim 13 wherein the shoe has a detent opening in its top portion, and including a distributor table cover, and detent means carried by the cover and extending into the detent opening.

15. In an impact crusher,
a rotatable distributor table,
plural impeller shoes mounted in spaced relation around the table,
at least one wear plate on said table for each shoe,
said distributor table having a mounting groove formed therein and extending therearound, said wear plate having a mounting rib projecting into said groove, each shoe overlying a portion of the associated wear plate in retaining relationship thereto.

16. In an impact crusher as recited in claim 15 in which there is a distributor cap centered on said table, said shoes having portions overlying portions of said cap in retaining relation thereto.

* * * * *